US005772226A

United States Patent [19]

Bobichon

[11] Patent Number: 5,772,226

[45] Date of Patent: Jun. 30, 1998

[54] LIFTING DEVICE FOR A STAND-UP WHEELCHAIR, AND A WHEELCHAIR USING THE SAME

[75] Inventor: Gérard Bobichon, Lemps, France

[73] Assignee: International Diffusion Consommateurs - I.D.C., Bourg de Peage, France

[21] Appl. No.: 545,569

[22] PCT Filed: Mar. 17, 1995

[86] PCT No.: PCT/FR95/00330

§ 371 Date: Mar. 25, 1996

§ 102(e) Date: Mar. 25, 1996

[87] PCT Pub. No.: WO95/25497

PCT Pub. Date: Sep. 28, 1995

[30] Foreign Application Priority Data

Mar. 18, 1994 [FR] France ..... 94 03439

[51] Int. Cl.[6] ..... A61G 5/00

[52] U.S. Cl. ..... 280/250.1; 297/316; 297/DIG. 10; 280/304.1; 180/907

[58] Field of Search ..... 280/250.1, 87.05; 180/907; 297/DIG. 4, 316

[56] References Cited

U.S. PATENT DOCUMENTS

| | | | |
|---|---|---|---|
| 3,882,949 | 5/1975 | Anderson | 280/5.3 X |
| 4,231,614 | 11/1980 | Shaffer | 297/330 |
| 4,456,086 | 6/1984 | Wier et al. | 180/11 |
| 4,569,556 | 2/1986 | Pillot | 297/316 |
| 4,809,804 | 3/1989 | Houston et al. | 180/65.5 |
| 5,203,610 | 4/1993 | Miller | 297/345 |
| 5,219,204 | 6/1993 | Bathrick et al. | 297/321 |
| 5,346,280 | 9/1994 | Deumite | 297/330 |

FOREIGN PATENT DOCUMENTS

| | | |
|---|---|---|
| 164480 | 12/1985 | France . |
| 468686 | 1/1992 | United Kingdom . |

*Primary Examiner*—Brian L. Johnson
*Assistant Examiner*—Avraham Lerner
*Attorney, Agent, or Firm*—Bacon & Thomas

[57] ABSTRACT

A wheelchair having a lifting device wherein the seat and the footrest are independent from each other and are mounted on the top ends of two deformable quadrilaterals extending upwards from the chassis and sharing a common moving portion, and wherein the raising and lowering control devices comprise a drive member interposed between the chassis and one of the moving members of one of the quadrilaterals, and suitable for controlling the displacement of said quadrilaterals between a stable folded state and a stable unfolded state.

12 Claims, 5 Drawing Sheets

LIFTING DEVICE FOR A STAND-UP WHEELCHAIR, AND A WHEELCHAIR USING THE SAME

FIELD OF THE INVENTION

The present invention relates to wheelchairs used by handicapped persons and invalids and it applies equally well to folding and to non-folding wheelchairs.

There is no doubt that wheelchairs have given mobility to handicapped persons and invalids. However, such wheelchairs suffer from several drawbacks due to the fact that their users can occupy only a sitting position, which position is generally maintained for relatively long periods of time. In an attempt to remedy this single way of using wheelchairs, various proposals have been made for "stand-up" wheelchairs enabling the user to be held substantially in a standing position.

PRIOR ART

As a general rule, the proposals made use a hinged structure comprising a back, a seat, and a footrest. Such a structure is hinged, generally via the seat, about a front horizontal axis that is perpendicular to the vertical plane of symmetry of the chassis, and drive means are interposed between the chassis and the structure to enable the structure to be raised or lowered, and thus to occupy a folded or "sitting" position or an unfolded or "standing" position. The drive member may be controlled manually, electrically, or otherwise.

To illustrate that prior art, mention may be made of French patent 69/35042, German application 2 625 045, or French patent 82/11713, amongst others.

Those various proposals do indeed satisfy the intended stand-up objective, and in that sense they have undeniably provided improved well-being to users.

The structural proposals in the prior art rely generally on hinging the hinged structure about a horizontal front axis that is perpendicular to the vertical plane of symmetry of the chassis and that is secured thereto.

In the stand-up position, that organization has the effect of transferring the hinged structure and the stood-up user towards the front of the wheelchair, thereby increasing the load on the front wheels and reducing the load on the back wheels.

That gives rise to instability, since the support polygon is not uniformly loaded. That is why, as a general rule, additional support points are provided to stabilize the wheelchair when the hinged structure is in the stand-up state. Such additional support points are frequently, if not always, constituted by castors, skids, props, or feet which are provided by construction to extend the footrest so as to bear on the ground when the hinged structure is in the stand-up state.

Although such a proposal, in the general sense, serves to provide a genuine factor of stability and safety for users, it nevertheless gives rise to a problem that is unavoidable when account is taken of the desire for wheelchairs to be movable even when the hinged structure is in the stand-up state. That corresponds to the perfectly understandable desire of users to be able to recover lifestyle and independence by such means.

Reconciling such a desire with the present technique appears to be incompatible with achieving good stability and, where appropriate, ease of handling.

In an attempt to satisfy those two requirements, proposals have been made in the prior art for a different structure.

Thus, e.g. as illustrated by patent U.S. Pat. No. 3,907,051, proposals have been made to place motor-drive means in a box located at the back in order to ballast the wheelchair so as to lower its center of gravity and compensate for the front overload that occurs in the stand-up position.

Such a proposal must indeed provide a partial solution to problems of stability and safety, but it does not appear to be usable in all configurations and with all kinds of energy that may be available for powering a wheelchair.

Also, such a proposal appears to be difficult to make compatible with the desire to have a wheelchair that is foldable to enable it to be transported easily, in particular in a motor vehicle.

In application WO 82/01314, the prior art has a different proposal which consists in mounting a hinged structure on the chassis of the wheelchair such that when the structure is moved into its stand-up position it moves backwards relative to the chassis, thereby placing the structure and the user substantially on the vertical axis passing through the center of the support polygon constituted or defined by the chassis.

That ensures that the general load in the stand-up position is distributed relative to the support polygon, thereby ensuring stability so that it is possible to envisage motorizing the wheelchair and moving it even in the stand-up position.

Nevertheless, on examining that proposal, it can be seen that the technology proposed in application WO 82/01314 is relatively complicated and uses a large number of hinge points between the various elements of the hinged structure and numerous links connecting the structure to the chassis.

Such numerous hinge connections make the structure relatively fragile, increase overall weight, and require constant maintenance in order to prevent any local misfunction which would give rise to defective folding or unfolding that could lead to accidents.

Also, a large fraction of the hinges are located near the front of the wheelchair, particularly in a zone in front of the seat, thus having the effect of impeding access thereto for a handicapped person or invalid.

In addition, the fact of causing the hinged structure to move backwards automatically implies that the footrest must move in the same direction, from a front position corresponding to a sitting state to a backwardly offset position corresponding to a standing state.

This front-back displacement during both movements means that enough clearance must be left for the footrest and poses a difficult-to-solve problem in fitting the swivel-mounted front wheels to the chassis, which wheels are generally of smaller diameter than the load-carrying back wheels, as is usually the case for wheelchairs.

This constraint complicates manufacture of the wheelchair, and makes it difficult for the size of the wheelchair, particularly its transverse size, to be kept compatible with the clearance available in use, particularly in the home, where it must be possible for the wheelchair to pass through doorframes of standard size.

The number of hinges and the large number of links also have the effect of adding considerable weight to the wheelchair equipped therewith, thus making it more difficult to handle while also requiring the user to expand more physical force when wheelchair displacement is not powered or power-assisted by on-board motorization.

The present invention seeks to remedy the above drawbacks by proposing novel connection means between a hinged structure and a chassis of a stand-up wheelchair, with such means not only making standing up possible, but also serving automatically and simultaneously with the standing-up operation to move the hinged structure backwards so as to cause the load in the standing position to be centered relative to the support polygon, thereby imparting sufficient stability and safety to the wheelchair in such a state for it to be mobile, with an option of being displaced manually or by motor means, and without any risk for the subject in the standing position.

Another object of the invention is to provide support and hinge means that are simple, reliable, light in weight, and cheap, so as to make them easy to fit, without thereby greatly increasing the weight of the wheelchair, and also making it possible, where appropriate, to fit them on folding wheelchairs.

SUMMARY OF THE INVENTION

To achieve the above objects, in the lifting device for a stand-up wheelchair of the invention:

the seat and the footrest are independent from each other and are mounted on the top ends of two deformable quadrilaterals extending upwards from the chassis and possessing a moving portion in common; and the means for controlling raising and lowering comprise a drive member interposed between the chassis and one of the moving members of one of the quadrilaterals, and suitable for causing said quadrilaterals to move between a stable, folded state corresponding to a "sitting" position for the structure and a stable, unfolded state corresponding to a "standing" position for the structure in which the mass represented by the structure is substantially centered relative to the support polygon.

The invention also provides a stand-up wheelchair including a hinged structure connected to the chassis by the above means.

Various other characteristics appear from the following description given with reference to the accompanying drawings which show embodiments of the invention as non-limiting examples.

BEST MANNER OF FORMING THE INVENTION

Figure 1:
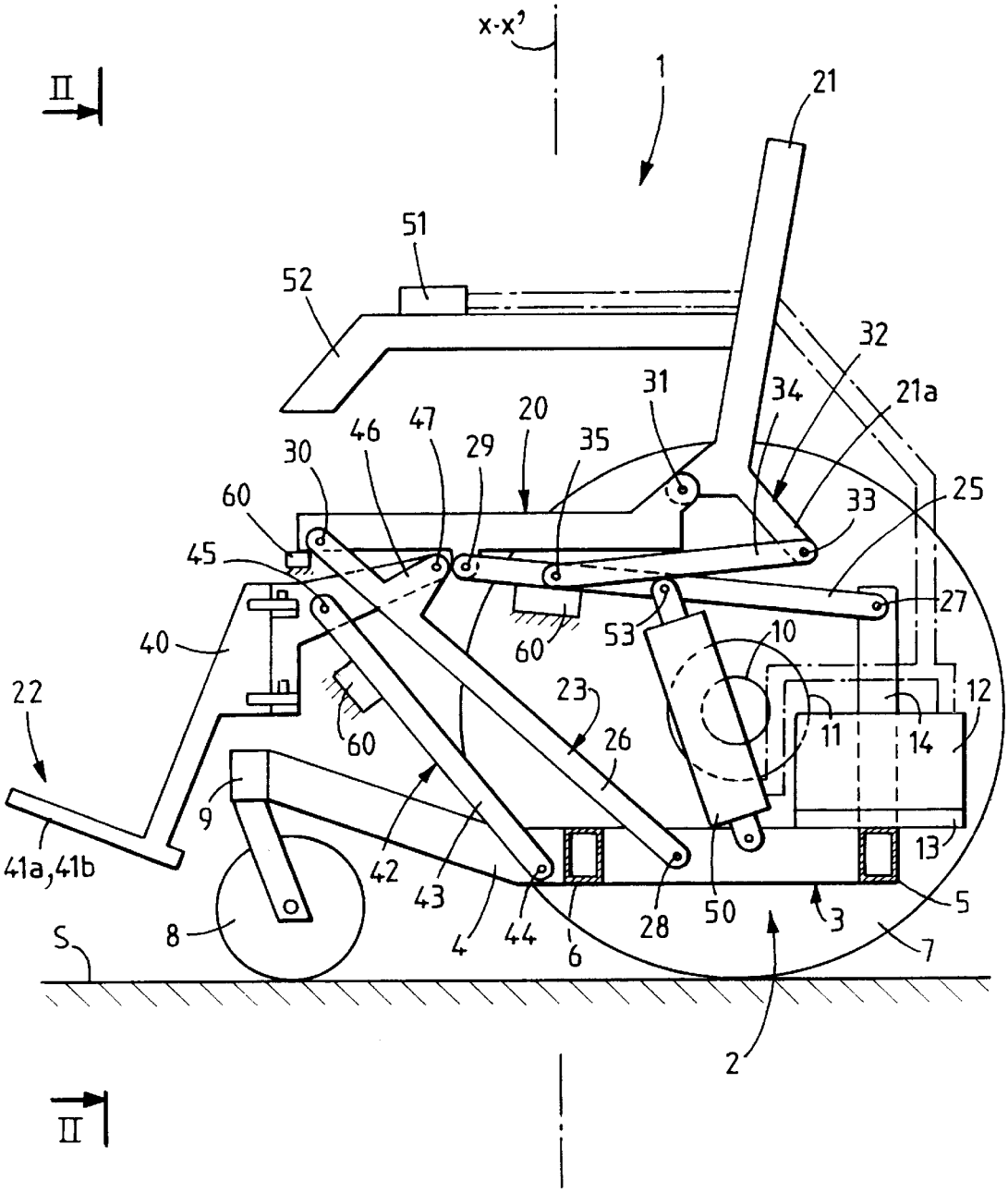
FIG. 1 is a diagrammatic side elevation of a wheelchair of the invention.
Figure 2:
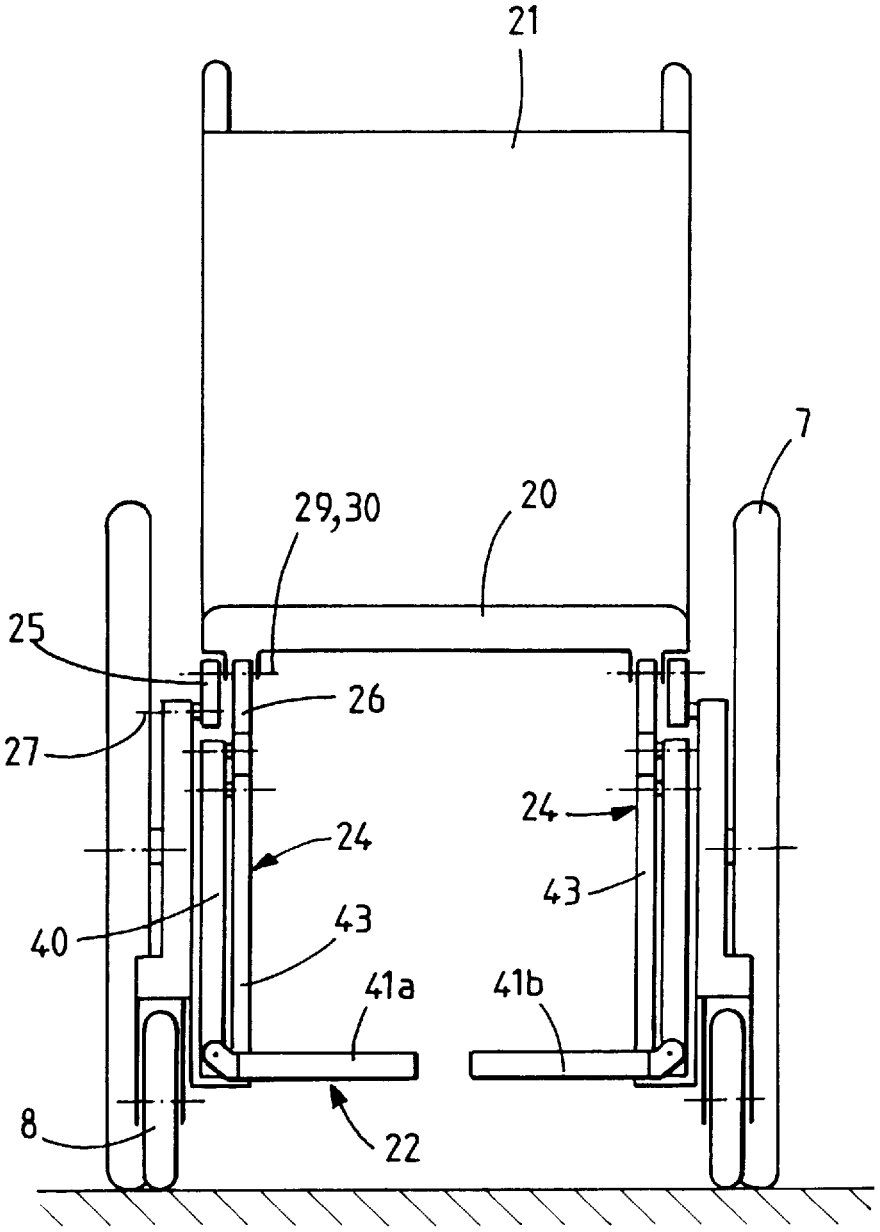
FIG. 2 is a front view as seen on line II—II of FIG. 1.

FIGS. 1 and 2 are a diagram showing a wheelchair 1 having a chassis 2 constituted by a bottom frame 3, e.g. comprising longitudinal beams 4 interconnected by tranverse or lateral cross bars 5 and 6. Naturally this embodiment is given merely by way of example and is shown diagrammatically solely for the purpose of avoiding excessive clutter in the drawing while enabling the invention to be understood. Thus, in conventional known manner, the chassis 2 is provided with wheels 7 that are generally load-carrying, main, and motor-driven, and wheels 8 that are castor-mounted and swivel from pivots 9. The wheels 8 are usually, but not necessary, placed at the front of the chassis 2, while the load-carrying wheels 7 are at the back thereof. Via their points of contact with the ground S, the wheels 7 and 8 define a support polygon having a vertical axis x—x' passing through the center thereof. The wheels 7 are mounted on the chassis 2 via bearings 10 and they may advantageously be associated with reversible motor drive means 11 such as electric motors suitable for being powered from an on-board electricity source 12 disposed on a bracket 13 placed between uprights 14.

Figure 4:
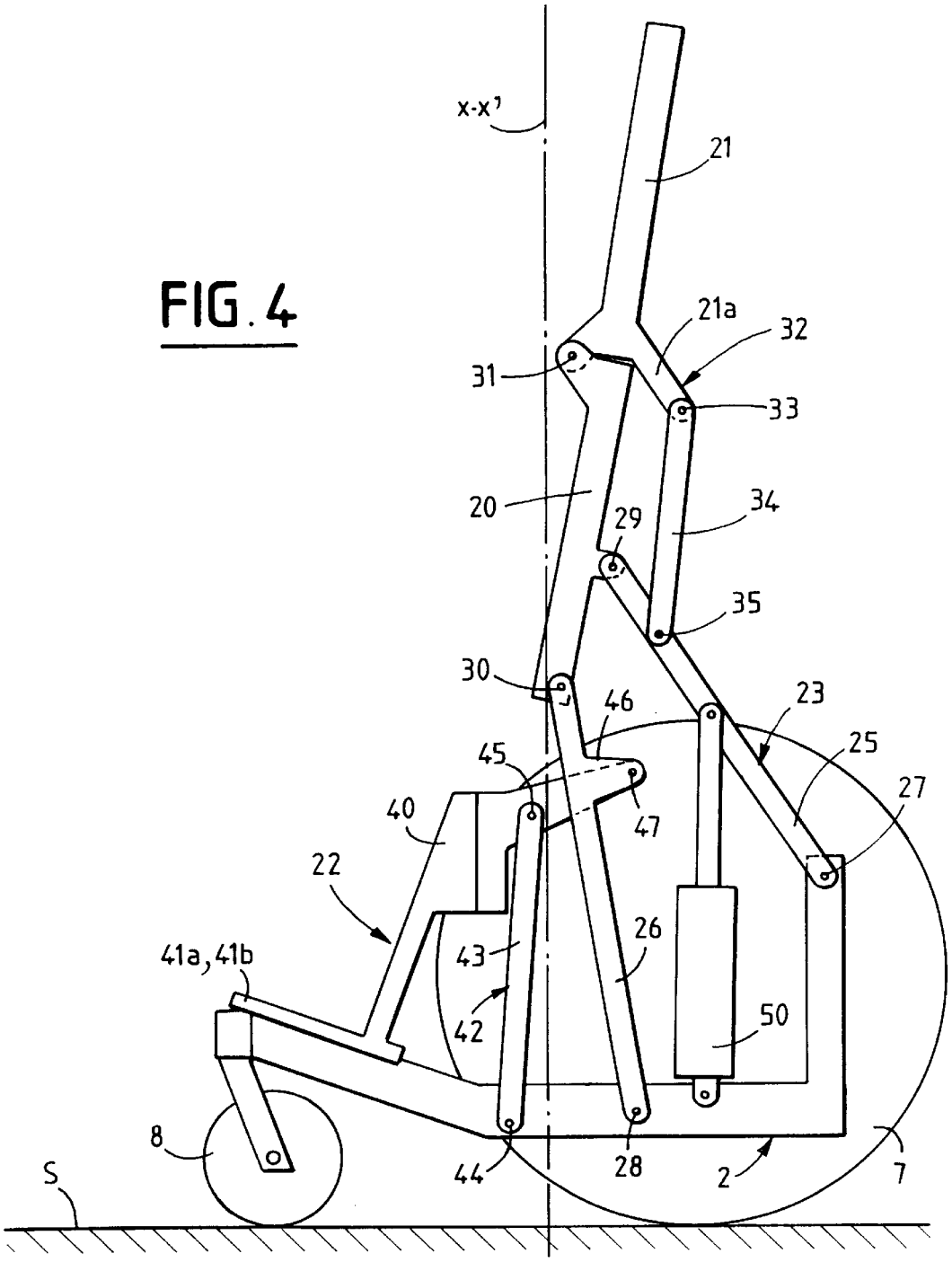

In conventional manner, the chassis 2 supports a hinged structure comprising a seat 20, a back 21, and a footrest 22. In known manner the hinged structure is organized to be capable of occupying a stable, folded state corresponding to a "sitting" position, as shown in FIG. 1, and also a stable, unfolded position corresponding to a "standing" position, as shown in FIG. 4 wherein the seat, back and foot rest are in general upright alignment. In both of these positions the hinged structure is equipped to support a handicapped person or invalid in a sitting position or in a standing position, as the case may be, by using means known in the art and not shown.

In the invention, the hinged structure is organized so that the seat 20 is carried by the chassis 2 via hinge means 23 in the form of a deformable quadrilateral, such means being organized, for example, in the form of two lateral linkages 24. Each lateral linkage comprises a back hinged portion or link 25 and a front hinged portion or link 26 which are respectively mounted via axes 27 and 28 on the back upright 14 and on the beams 4. The top ends of the hinged portions or links 25 or 26 carry the seat 28 via respective hinge axes 29 and 30 respectively located substantially in the middle portion of the bottom face of the seat 20 and at the front thereof. In the folded state, the portion 25 extends forwards in a substantially horizontal direction from the uprights 14, whereas the front hinged portion 26 also extends forwards but with a rising inclination from the chassis 2.

In the invention, the back 21 is mounted via a hinge axis 31 on the back portion of the seat 20 and it is connected thereto via hinge means 32 in the form of a deformable quadrilateral. The means 32 include a moving portion which is in common with the deformable quadrilateral 23.

By way of example, the means 32 may be constituted by an extension 21*a* extending downwards from the back 21 and on which a moving portion 34 such as one or two links is hinged about an axis 33, the link(s) being connected about an axis 35 to the back link portion(s) 25 constituting the deformable quadrilateral 23 the third deformable quadrilateral thus comprises a link 34 connected to linkage 25 of the first deformable quadrilateral; a link of linkage 25 between connectors 35 and 29; a link of the seat between connections 29 and 31; and the extension 21*a*.

The moving portion 34 may also be organized as two lateral linkages in the same manner as the linkages 24.

The footrest 22 is preferably constituted by two leg-pieces 40 each provided at its bottom end with a sole flap 41. The two leg-pieces 40 are independent and they are not hinged to the seat 20, instead they are carried by the chassis 2 via hinge means 42 preferably of the deformable quadrilateral type and organized like the other quadrilaterals in the form of two lateral linkages. Each lateral linkage comprises a front portion 43 hinged about an axis 44 to the chassis 2 and carrying the corresponding leg-piece via a top hinge axis 45. Each lateral linkage also makes use of an element in common with the deformable quadrilateral 23 as so to make up a deformable quadrilateral, with the common element being constituted by the front portion 26 which, under such circumstances, is situated behind the front portion 42. To make this possible, the front portion 26 is provided, beneath its hinge connection 30 to the seat 20, with an extension 46 on which the leg-piece 40 is mounted via a hinge axis 47.

The front portion 43 of each deformable quadrilateral 42 extends forwards with a rising slope from the chassis 2 to the leg-piece 40.

As can be seen in FIG. 1, the deformable quadrilateral system 23 is defined by hinge points 27, 28, 29, and 30. The deformable quadrilateral hinge system 32 is defined by hinge points 29, 31, 33, and 35. The hinge system 42 based on a deformable quadrilateral is defined by hinge points 28, 44, 45, and 47.

In the invention, provision is made for the lifting device described above to be provided with a drive member 50 enabling the hinged structure to go from its position shown in FIG. 1 to its position shown in FIG. 4, and back again. Such a drive member 50 may be constituted by a manually controlled mechanism, or preferably by an energy-transforming mechanism of the electrical actuator type that is suitable for being powered from the electricity source 12, in particular via a control switch 51 that is accessibly-located, e.g. on one of the removable or foldable arms 52 fitted to the back 21 or to the seat 20. The drive member 50 is interposed between the chassis 2 and one of the moving elements of one of the deformable quadrilaterals, and preferably the element 25 connected to the seat 20. In an appropriate example as shown in FIG. 1, the drive member 50 is constituted by an electrical actuator whose base is fitted to the chassis 2 and whose rod is hinged, for example, about an axis 53 of a cross-member interconnecting the portions 25 of the two lateral linkages 24.

When a drive member 50 is used that is manually-driven, provision may be made for resilient compensation means such as gas actuators that serve to reduce the load, particularly while the hinged structure is being unfolded from its state shown in FIG. 1 to the stand-up state shown in FIG. 4.

Although not shown, the chassis 2 may be designed to have one or more abutments 60 for holding the hinged structure in its folded state, e.g. by co-operating directly or indirectly with the seat 20 and/or with an appropriate one of the deformable quadrilaterals.

In the state shown in FIG. 1, the hinged structure is in its folded position such that the seat 20 is substantially horizontal and the footrest 22 lies immediately in front of the front portion of the chassis and the transverse plane of the swivel pivots for the castors B.

When it is desired to cause the hinged structure to change state so as to occupy a stand-up position, the drive member 50 is actuated, e.g. to extend its rod, thereby raising the hinged elements 25 forming parts of the deformable quadrilaterals 23 associated with the seat 20. The hinged elements 25 are thus caused to pivot in the direction of arrow $f_1$ (FIG. 3) about the axes 27, thereby displacing the axis 29 along a circular trajectory $T_1$ whose center is the axis 27 and whose radius is the length of the elements 25.

Displacement of the axis 29 entrains the seat 20 in the same direction so that its hinge axis 30 is displaced along a circular trajectory $T_2$ whose center is the axis 28 and whose radius is the length of the front portion 26. The structural characteristics of the deformable quadrilateral 23 are such that the curves $T_1$ and $T_2$ intersect at a point $O_1$ (as shown in FIG. 3) so that the seat being displaced backwards is simultaneously subjected to relative pivoting in the direction of arrow $f_2$.

Simultaneously, the pivoting of the seat 20 causes the axis 31 to be moved upwards, thereby subjecting the back 21 to displacement relative to the seat although continuing to remain at substantially the same inclination. This characteristics is provided by the structure of deformable quadrilateral 32.

The displacement of the point 30 along the curve $T_2$ causes hinge point 47 of deformable quadrilateral 42 to move along curve $T_3$, with the trajectory $T_3$ having hinge point 28 as its center and having a radius corresponding to the portion of the link 26 that extends between said point and the axis 47. Via the leg-pieces 40, the hinge points 45 are displaced along a circular trajectory $T_4$ whose center is the axis 44 and whose radius is the length of the front elements 42.

Figure 3:
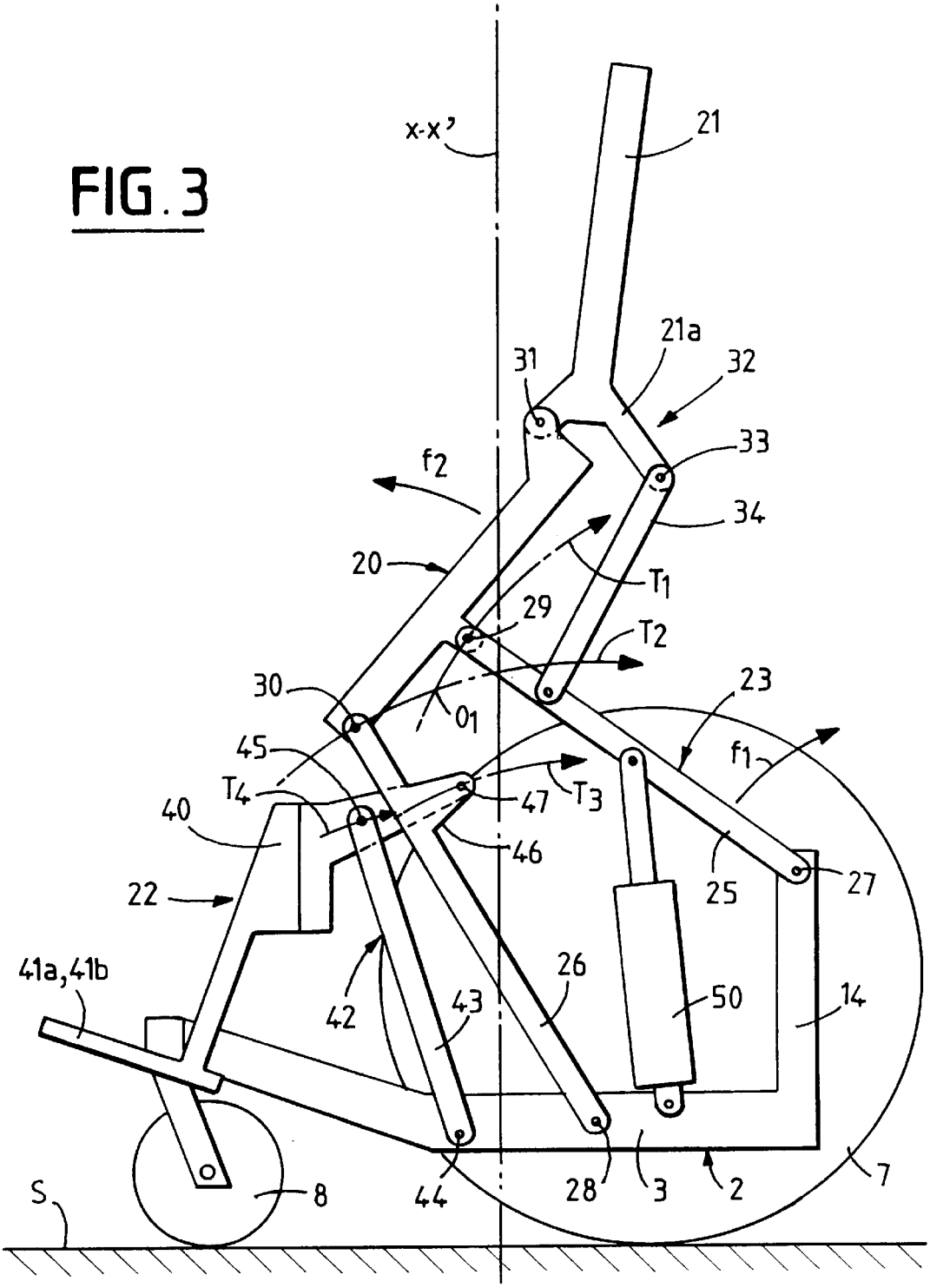
FIGS. 3 and 4 are views analogous to FIG. 1, showing the wheelchair in two characteristic positions.

This characteristic ensures that during the intermediate stage that coincides with displacement of the seat 20 along arrow $f_2$, the footrest 22 is raised and displaced backwards, as can be seen in FIG. 3. The amount of lifting is determined by the structural characteristics of the deformable quadrilateral 42 such that when the sole flaps 41 lie above the horizontal pivoting envelope of the front wheels 8 with their initial inclination, they are situated at a height above the ground S that is greater than the diameter of the wheels. This ensures that the footrest 22 can be moved backwards freely whatever the position in which the swivelling front wheels 8 are pointing.

The characteristics of the deformable quadrilaterals are selected by construction so that once the drive member 50 has moved along its active stroke, the seat 20 and the back 21 are located substantially in alignment at a small inclination, whereas the footrest 22 is moved backwards to be included within the support polygon defined by the wheels 7 and 8. In this "stand-up" state, and as can be seen in FIG. 4, the hinged structure is distributed overall on either side of the vertical axis x—x' so that the load or mass that it represents on its own plus that constituted by the subject in the standing position lies on said vertical axis x—x' and substantially in the center of the support polygon so as to ensure that the wheelchair, once put into this configuration, is in a stable state enabling it to be displaced by means of its wheels.

The structural characteristic of the support means and of the hinge system based on three deformable quadrilaterals is such as to cause the back, the seat, and the footrest to move along trajectories $T_1$, $T_2$, $T_3$, and $T_4$ which extend towards the back portion of the wheelchair, thereby displacing the hinged structure backwards so as to bring it from a somewhat forward sitting position towards a standing position that is substantially cantered on the axis x—x'.

As can be seen by comparing FIGS. 1, 3, and 4, the means of the invention make it possible in the standing position to reduce bulk considerably in the front-back plane of the wheelchair, and to impart a compact configuration to the wheelchair in this state that is favorable to moving about.

Operation in reverse to that described above takes place when the member 50 is caused to return the hinged structure from its stand-up position to the sitting position shown in FIG. 1.

Figure 5:
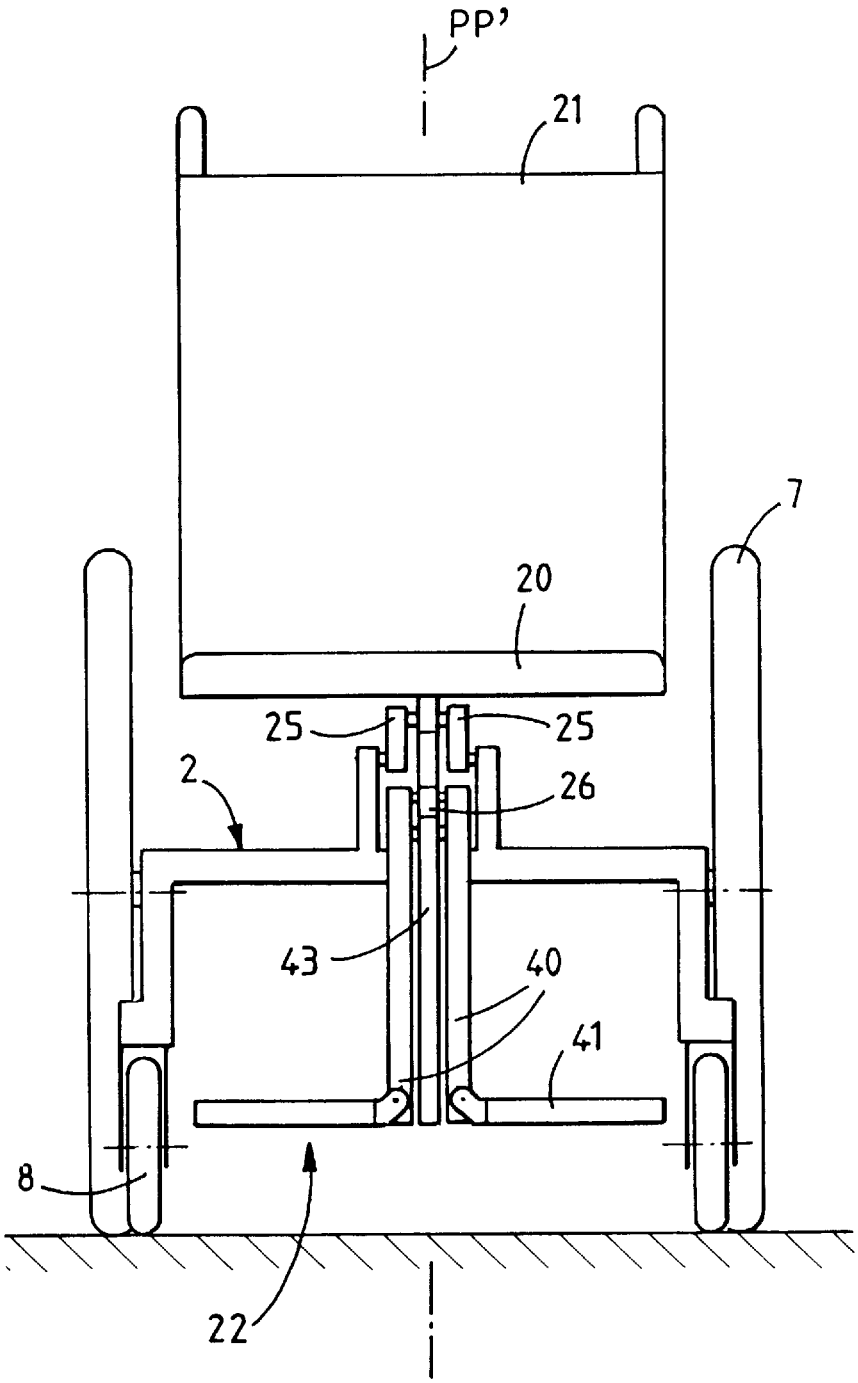
FIG. 5 is a front view analogous to FIG. 2, but showing a variant embodiment.

FIG. 5 shows a variant embodiment in which the deformable quadrilaterals are no longer organized as lateral linkages such as 24, but in the form of a column, being brought together on either side of the front-back vertical plane of symmetry P—P'.

INDUSTRIAL APPLICATION

Particularly advantageous industrial application for the invention lies in stand-up wheelchairs which, are also capable of being folded about a longitudinal vertical plane of symmetry so as to take up less space while being transported, particularly by car.

The invention is not limited to the examples described and shown since various modifications can be applied thereto without going beyond the ambit of the invention.

I claim:

1. A lift device mounted to a wheelchair including a chassis extending longitudinally and transversely relative to the wheelchair, wheels carried by the chassis defining a support polygon, the chassis also supporting hinged structures including at least a seat, a leg piece carrying a foot rest and a back rest, said seat, leg piece and back rest each being movable between a folded sitting position and an unfolded standing position, wherein the lift device comprises:

a first quadrilateral device comprising a first pair of linkages having opposed ends extending between the chassis and the seat, each linkage pivotally connected at a first end to the seat and at a second end to the chassis, the connections between said first ends and the seat and between said second ends and the chassis being longitudinally spaced apart along the seat and chassis, respectively;

a second quadrilateral device comprising a second pair of linkages each having opposed ends connected respectively to the leg piece at first ends thereof and to the chassis at second ends thereof, said connections between said first ends and the leg piece and between the second ends and the chassis being longitudinally spaced apart along the leg piece and chassis, respectively;

said first and second quadrilateral devices sharing a common linkage and said leg piece being supported by the second quadrilateral device for motion that is independent of the motion of the seat;

a device for moving at least one linkage of the quadrilateral devices pivotally about an end of the one linkage connected to the chassis to move the quadrilateral devices, the seat and the leg piece simultaneously between folded and unfolded positions relative to the chassis;

said seat and foot rest at said unfolded position being located in general upright alignment within the support polygon.

2. A lift device according to claim 1, wherein the motion of the connections between said first ends of said linkages of said first quadrilateral device and said seat solely determine the motion of said seat, said seat not otherwise being connected to the chassis during pivotal motion of said linkages of said first quadrilateral device.

3. A lift device according to claim 1, said seat including a longitudinally rearward portion and said back rest including a base section pivotally connected to the rearward portion of the seat, and further comprising:

a third quadrilateral device comprising:

a link between said back rest and a linkage of said first quadrilateral device; a length of said last-recited linkage of said first quadrilateral device; a length of the seat between the connection of the last-recited linkage of the first quadrilateral device to the seat and the connection between the back rest base section and the seat; and a back rest extension extending between the back rest and said link extending between the back rest and said last-recited linkage of the first quadrilateral device.

4. A lift device according to claim 1, wherein said first and second pairs of linkages of said first and second quadrilateral devices are each constituted of laterally spaced pairs of linkages connected between the seat and chassis in the manner recited with respect to said first and second pairs of linkages.

5. A lift device according to claim 1, wherein said linkages of said first and second quadrilateral devices are located adjacent to each other centrally between the wheels and below the seat when the seat is in the folded position.

6. A lift device according to claim 1, wherein the wheel chair chassis includes a lower portion and a raised rear portion located above the lower portion, and wherein one of said pair of linkages of said first quadrilateral device extends from a forward area of the seat to the lower portion of the chassis and the other of said pair of linkages of said first quadrilateral device extends from a longitudinal middle area of the seat and the raised rear portion of the chassis.

7. The lift device according to claim 1, wherein the chassis includes a lower portion and said leg piece includes forward and rear portions; and wherein said common linkage extends from the lower portion of the chassis to the rear portion of the leg piece and the other of the pair of linkages of said second quadrilateral device extends from the lower portion of the chassis to the forward portion of the leg piece.

8. A lift device according to claim 1, wherein said device for moving at least one linkage is an energy transformer.

9. A lift device according to claim 1, wherein said device for moving at least one linkage is a manual drive device and including a resilient load reducing compensator arrangement to assist the manual device for unfolding the seat, leg piece and back rest.

10. A lift device mounted to a wheelchair including a chassis extending longitudinally and transversely relative to the wheelchair, wheels carried by the chassis defining a support polygon, the chassis also supporting hinged structures including at least a seat, a leg piece carrying a foot rest and a back rest, said seat, leg piece and back rest being movable between a folded sitting position and an unfolded standing position, wherein the lift device comprises:

a first quadrilateral device comprising a first pair of linkages having opposed ends extending between the chassis and the seat, each linkage pivotally connected at a first end to the seat and at a second end to the chassis, the connections between said first ends and the seat and between said second ends and the chassis being longitudinally spaced apart along the seat and chassis, respectively;

a second quadrilateral device comprising a second pair of linkages each having opposed ends connected respectively to the leg piece at first ends thereof and to the chassis at second ends thereof, said connections between said first ends and the leg piece and between the second ends and the chassis being longitudinally spaced apart along the leg piece and chassis, respectively;

said first and second quadrilateral devices sharing a common linkage;

a device for moving at least one linkage of the quadrilateral devices pivotally about an end of the one linkage connected to the chassis to move the quadrilateral devices, the seat and the leg piece simultaneously between folded and unfolded positions relative to the chassis;

said seat and foot rest at said unfolded position being located in general upright alignment within the support polygon;

said seat including a longitudinally rearward portion and said back rest including a base section connected to the rearward portion of the seat;

a third quadrilateral device comprising:

a link between said back rest and a linkage of said first quadrilateral device; a length of said last-recited linkage of said first quadrilateral device; a length of the seat between the connection of the last-recited linkage of the first quadrilateral device to the seat and the connection between the back rest base section and the seat; and a back rest extension extending between the backrest and said link extending between the back rest and said last-recited linkage of the first quadrilateral device.

11. A lift device according to claim 10, wherein the motion of the connections between said first ends of said linkages of said first quadrilateral device and said seat solely determine the motion of said seat, said seat not otherwise being connected to the chassis during pivotal motion of said linkages of said first quadrilateral device.

12. A lift device according to claim 11, wherein said leg piece is supported by the second quadrilateral device for motion in folding and unfolding directions that is independent of the motion of the seat in folding and unfolding directions.

* * * * *